US007138033B2

(12) United States Patent
Hayasaka

(10) Patent No.: US 7,138,033 B2
(45) Date of Patent: Nov. 21, 2006

(54) CONNECTING APPARATUS AND CONNECTING METHOD OF WEB MATERIAL

(75) Inventor: Takuya Hayasaka, Tokyo (JP)

(73) Assignee: Lintec Corporation, Tokyo (JP)

( * ) Notice: Subject to any disclaimer, the term of this patent is extended or adjusted under 35 U.S.C. 154(b) by 0 days.

(21) Appl. No.: 10/935,281

(22) Filed: Sep. 8, 2004

(65) Prior Publication Data

US 2005/0051257 A1 Mar. 10, 2005

(30) Foreign Application Priority Data

Sep. 9, 2003 (JP) ..... 2003-316504

(51) Int. Cl.
*B65H 21/00* (2006.01)
*B65H 69/06* (2006.01)

(52) U.S. Cl. ..... 156/304.3; 156/304.1; 156/504; 156/505; 156/507; 242/552; 242/556

(58) Field of Classification Search ..... 156/304.1, 156/304.3, 502, 504, 505, 507; 242/551, 242/552, 555.2, 555.6, 556
See application file for complete search history.

(56) References Cited

U.S. PATENT DOCUMENTS

RE29,365 E * 8/1977 Butler, Jr. ..... 242/552

(Continued)

FOREIGN PATENT DOCUMENTS

EP 0 273 287 A 7/1988

(Continued)

OTHER PUBLICATIONS

Austrian Office Action dated Jan. 4, 2006 (No Translation provided).

*Primary Examiner*—Mark A. Osele
(74) *Attorney, Agent, or Firm*—Westerman, Hattori, Daniels & Adrian, LLP.

(57) ABSTRACT

The present invention simplifies an apparatus and is capable of, when replacing a roll, swiftly connecting the tail end side portion of a previously paid out web material and the lead end portion of web material to be paid out subsequently. A connecting apparatus 15 comprises a pay-out device 21, which is arranged so as to sequentially pay out web material M, which is wound on a first and second rolls 12 and 13, and a connecting device 22 that connects the portion at the tail end 12*a* (13*a*) side of the web material M from either one of the rolls 12 and 13 and the portion at the lead end 12*b* (13*b*) of the web material M from the other roll 12 (13). At the tail end 12*a* (13*a*) side, of the web material M, substantially a half of a connecting sheet M1 is stuck thereto. The connecting device 15 is arranged so that, when the tail end 12*a* (13*a*) of the web material M from either one of the rolls 12 and 13 has reached a predetermined position, the tail end 12*a* (13*a*) and the lead end 12*b* (13*b*) are aligned with each other, and the respective web material M from the first and second rolls 12 and 13 are connected to each other via the connecting sheet M1.

3 Claims, 11 Drawing Sheets

U.S. PATENT DOCUMENTS

| | | | | | |
|---|---|---|---|---|---|
| 4,328,066 | A | * | 5/1982 | Kiuchi et al. | 156/506 |
| 4,501,630 | A | * | 2/1985 | Kiuchi | 156/159 |
| 5,388,387 | A | * | 2/1995 | McElvy | 53/451 |
| 5,738,744 | A | * | 4/1998 | Washizaki et al. | 156/159 |
| 5,783,007 | A | | 7/1998 | Boyd et al. | |
| 5,853,141 | A | * | 12/1998 | Heiber et al. | 242/552 |
| 5,855,714 | A | * | 1/1999 | Bockh | 156/157 |
| 6,013,148 | A | | 1/2000 | Bluemle | |
| 6,331,222 | B1 | | 12/2001 | Hotkowski et al. | |
| 6,500,288 | B1 | * | 12/2002 | Hara et al. | 156/159 |
| 6,565,034 | B1 | * | 5/2003 | Hesse et al. | 242/556.1 |
| 2004/0084561 | A1 | * | 5/2004 | Clifford et al. | 242/552 |

FOREIGN PATENT DOCUMENTS

| | | | |
|---|---|---|---|
| EP | 0 705 782 | B1 | 4/1996 |
| EP | 0 758 621 | A2 | 2/1997 |
| JP | 59194961 | A | 11/1984 |
| JP | 2002-332146 | | 11/2002 |

* cited by examiner

CONNECTING APPARATUS AND CONNECTING METHOD OF WEB MATERIAL

BACKGROUND OF THE INVENTION

1. Field of the Invention

The present invention relates to a connecting apparatus and connecting method in which web materials paid out from a plurality of rolls are connected, and in particular, to a connecting apparatus and connecting method wherein the tail end side portion of web material from one roll and the lead end side portion of web material from another roll can be connected automatically.

2. Description of the Back Ground Art

Conventionally, there is used a label laminating apparatus in which a roll of web material having a plurality of labels on a release liner, is set to a predetermined. position, and the web material is paid out from the roll, the labels are peeled off therefrom one by one and stuck to objects to be applied therewith. In the above apparatus, when the web material has been paid out and the roll is replaced with a new one, such troublesome operation is required. That is, the lead end of the web material from the new roll replaced has to be set to the initial position. Accordingly, there resides such problem that the operating efficiency of the label laminating apparatus is reduced.

In order to solve the above problem, the applicant of the present invention has proposed a connecting apparatus, which is disclosed in a patent document (Japanese Unexamined Patent Application Publication No. 2002-332146). The connecting apparatus is arranged to connect the tail end side portion of a paid out web material to the lead end portion of web material to be paid out subsequently using a connecting piece.

SUMMARY OF THE INVENTION

However, in the connecting apparatus disclosed in the patent document has following problems. That is, a labeler for sequentially feeding connecting pieces and a label holding plate for temporarily holding connecting pieces fed from the labeler, and the like are required. Accordingly, the apparatus becomes complicated resulting in a large size of the apparatus. Further, since the mechanism is complicated, there resides such problem that it takes a long time to connect the web material to each other.

OBJECT OF THE INVENTION

The present invention has been proposed in view of the above problems. Accordingly, an object of the present invention is to provide a connecting apparatus and a connecting method of web material, which enables the simplification of the apparatus, and is capable of, when replacing a roll, connecting swiftly the tail end side portion of the web material previously paid out and the lead end portion of web material to be paid out subsequently.

In order to achieve the above object, the present invention employs the following arrangement; that is, a connecting apparatus for web material, comprising:

a pay-out means arranged so as to sequentially pay out the first and the second rolls of web material to which substantially a half area of a piece of connecting sheet is stuck at the tail end side thereof, and a connecting means, which connects the tail end side portion of the web material from one roll and the lead end side portion of the web material from another roll to each other, wherein the connecting means, when the tail end of the web material from one roll reaches a predetermined position, in a state that the tail end and the lead end are aligned with each other, connects each web material of the first and the second rolls via a connecting sheet.

In the present invention, such an arrangement may be adopted that the connecting means comprises a first holding means capable of holding the lead end side portion of the web material from a first roll, a second holding means capable of holding the lead end side portion of the web material from a second roll, a receiving table capable of holding the web material from the lower surface side thereof, and a pressuring means disposed between the receiving table and the first and second holding means Furthermore, each of the first and second holding means comprises the holding section which has a suction surface capable of holding the lead end side portion, and is arranged so that the holding section is rotated to move between a pay-out position and an waiting position.

Further, the present invention employs the following method; that is, a connecting method of web material using a pay-out means, which sequentially pays out the first and the second rolls of web material to which substantially a half area of a piece of connecting sheet is stuck at the tail end side thereof, and a connecting means, which connects each other the tail end side portion of the web material from one roll and the lead end side portion of the web material from another roll, comprising the steps of:

after the tail end has reached a predetermined position by the pay-out means, positioning the tail end and the lead end to align with each other with the connecting means, and then applying the remaining half portion of the connecting sheet to the lead end portion from a roll to be connected with the connecting means.

According to the present invention, a connecting sheet appears at the tail end side of a paid out web material. It makes possible to connect readily and swiftly to the web material to be paid out from the next roll via the connecting sheet. Owing to this arrangement, a conventional labeler or the like can be eliminated resulting in simplification of the apparatus. And further, when the connecting apparatus is applied to a label laminating apparatus, since the mechanism thereof is simple, the time required for connection can be reduced.

Further, when a plurality of labels are disposed in the extending direction of the web material, the labels can be used to the last label, eliminating the waste of the labels.

DESCRIPTION OF THE PREFERRED EMBODIMENT

Hereinafter, embodiments of the present invention will be described with reference to the drawings.

Figure 1:
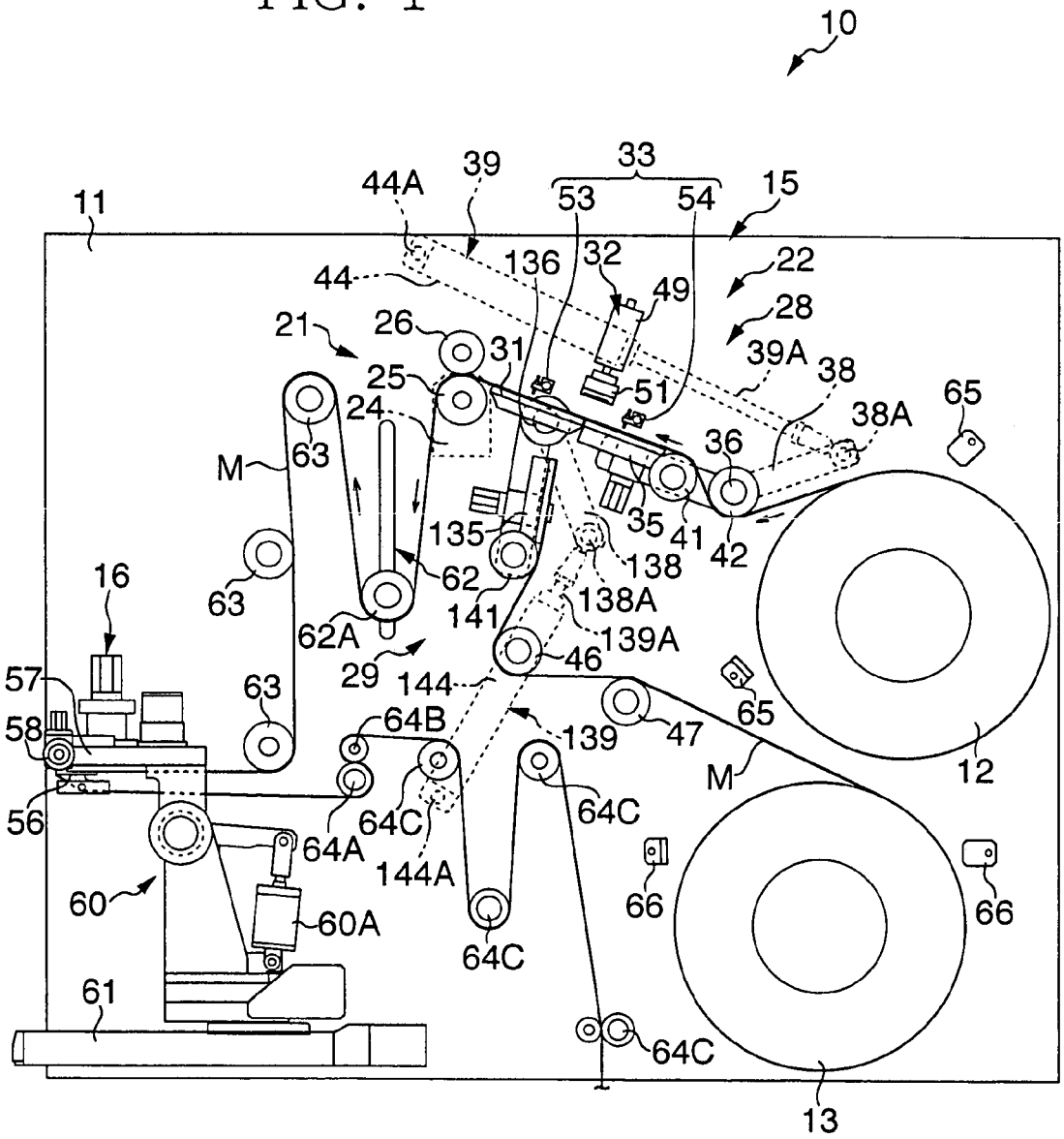
FIG. 1 is a schematic view showing an arrangement, in which a connecting apparatus in accordance with an embodiment of the present invention is applied to a laminating apparatus.

In this description, if not otherwise specified, the directions and positional terms in FIG. 1 are used as the standard.

Figure 2:
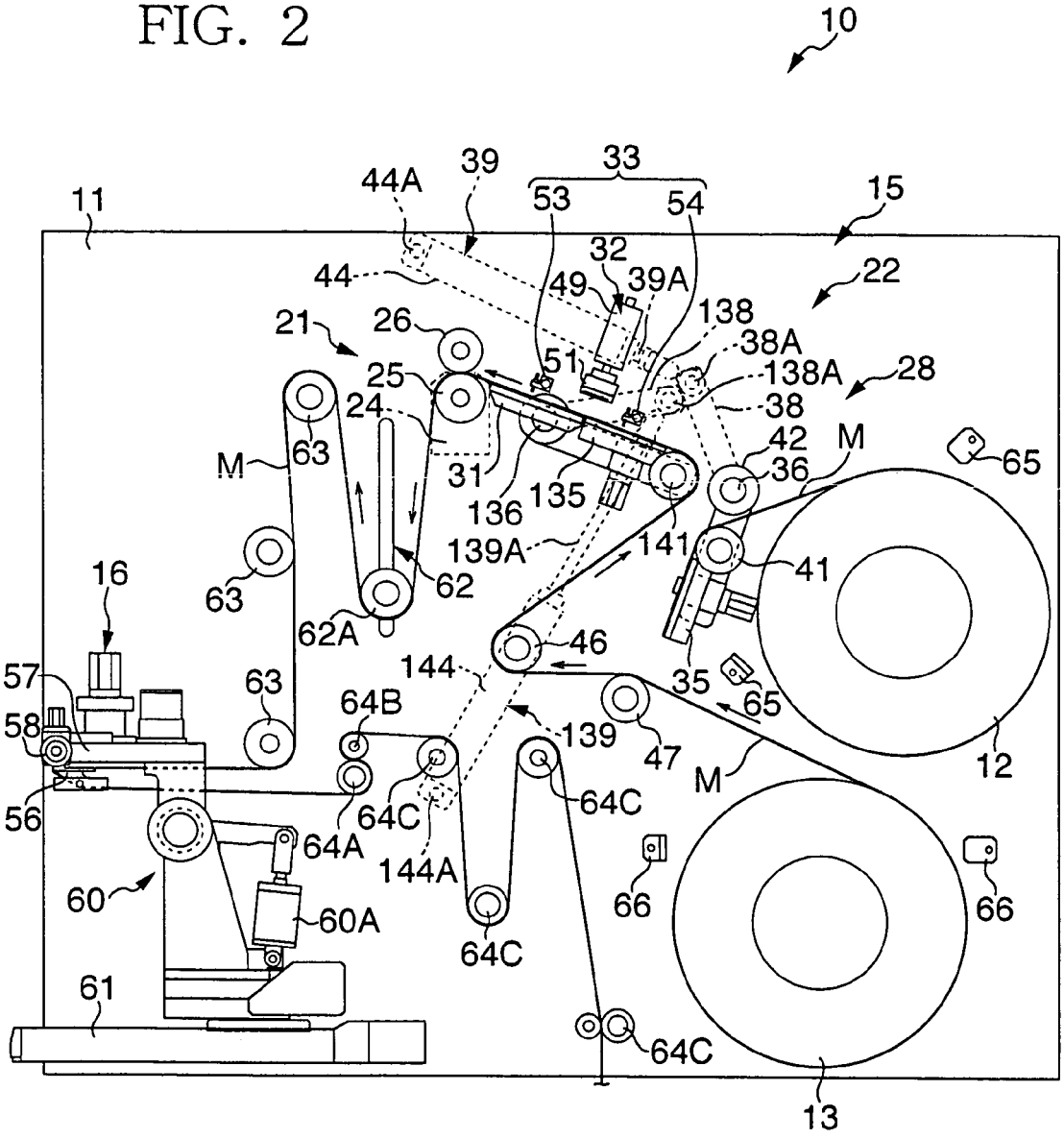
FIG. 2 is a schematic view showing the same configuration as that shown in FIG. 1, in which a state that web material is paid out from a second roll is illustrated.

FIG. 1 and FIG. 2 are schematic views showing an arrangement of a laminating apparatus to which a connecting apparatus in accordance with the present invention is applied. Here, FIG. 1 is a diagram schematically showing the arrangement of the laminating apparatus, which pays out web material from a first roll. FIG. 2 is a diagram showing the same arrangement as that in FIG. 1, which pays out web material from a second roll. Referring to these figures, the laminating apparatus 10 includes a panel 11, which is square in shape viewed from the front and forms a housing thereof. It is arranged so that, in the central right area of the panel 11, a first roll 12 is supported rotatably; and in the lower left area of the first roll 12, a second roll 13 is supported rotatably. Also, the laminating apparatus 10 comprises a connecting apparatus 15, which is disposed at the left side of the rolls 12 and 13, and a laminating means 16, which is disposed at the left side of the connecting apparatus 15.

Figure 3:
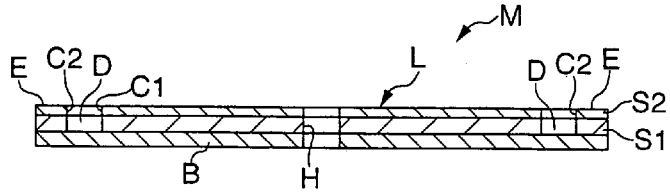
FIG. 3(A) is an enlarged view showing a section taken along the line A—A viewed from the arrowheads in FIG. 3(B)
FIG. 3(B) is a plan view of the web material.
FIG. 3(C) is an enlarged front view showing a section of a peripheral portion around the core in a first or second roll.
FIG. 3(D) is a plan view showing the lead end and the tail end of the web material.
Figure 3:
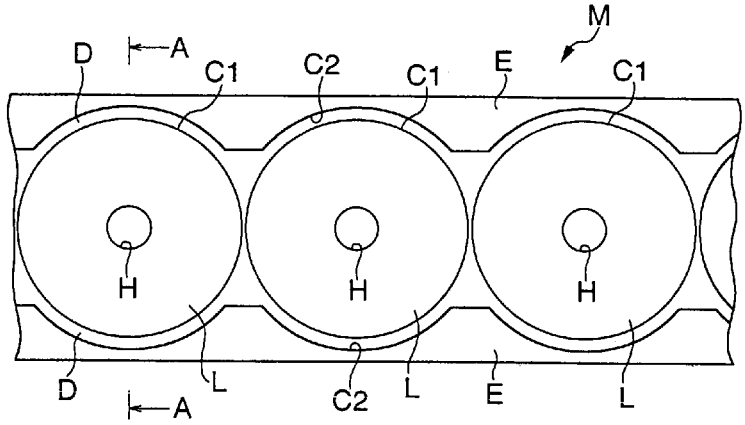
Figure 3:
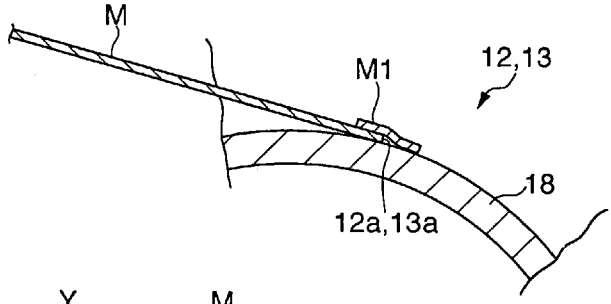
Figure 3:
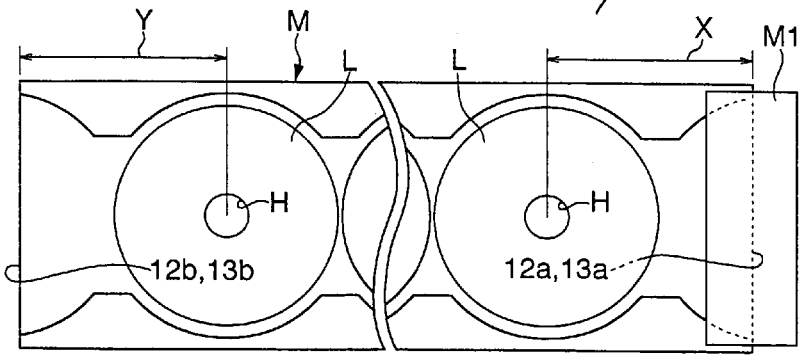

As shown in FIG. 3(A), web material M, which is wound on each of the first and second rolls 12 and 13 comprises a base sheet B, which serves as a release liner, an energy beam curable adhesive layer S1 positioned on the upper surface of the base sheet B in FIG. 3(A), and a protect film layer S2, which is laminated on the upper surface of the energy beam curable adhesive layer S1 in FIG. 3(A). In the respective layers S1 and S2 on the base sheet B, a disk-like precut C1 (refer to FIG. 3(B)), the inner side of which serves as a label L is formed at a predetermined pitch; and a wave-like precut C2 is formed at both the upper and lower sides of the disk-like precut C1 in FIG. 3(B). Formed between the disk-like precut C1 and the wave-like precut C2 is a disposable-part area D which is formed by removing the layers S1 and S2 in the prior process. And formed at the right and left sides of the disposable-part area D in FIG. 3(A) are cushions E. The cushions E prevent the label L from being formed with a trace or a cut caused by the label L, which is wound in a roll-like shape.

Formed in the central area of the surface of each label L is a round hole H substantially concentric with the disk-like precut C1. The round hole H is formed so as to penetrate the web material M. Owing to this arrangement, the label L is formed into a plane shape of a recording substrate such as optical disk (not shown); i.e., a shape substantially corresponding to a doughnut-like shape. The label L is peeled off from the base sheet B and stuck to the surface of a disk substrate (not shown) made of polycarbonate or the like via the laminating means 16. In this state, the protect film layer S2 is peeled off, and fine convexes and concaves such as pits are formed in the energy beam curable adhesive layer S1; thus the recording substrate is formed. The convexes and concaves are formed in the following manner. That is, a stamper (not shown) having a convex and concave surface is applied to the energy beam curable adhesive layer S1, and after irradiating ultraviolet beam from the disk substrate side to cure the resin layer, the stamper is peeled off.

As shown in FIG. 3(C), provided at the tail end 12*a* (13*a*) side of each web material M in the first and second rolls 12 and 13 is a piece of connecting sheet M1. The connecting sheet M1 has an adhesive layer containing an adhesive agent, which can be adhered again to the rear face (lower surface side FIG. 3(C)) of the web material M. Approximately a half of the connecting sheet M1 is stuck to the web material M at the tail end 12*a* (13*a*) as a boundary, and the rest thereof is stuck to core 18 of the roll 12(13). As shown in FIG. 3(D), in the first and second rolls 12 and 13, the distance X between the tail end 12*a* (13*a*) of the web material M and the round hole H closest to the tail end 12*a* (13*a*) is set. to a predetermined length. Also, the distance Y between the lead end 12*b* (13*b*) and the round hole H closest to the lead end 12*b* (13*b*) is set to a predetermined length.

As shown in FIG. 1 and FIG. 2, the connecting apparatus 15 comprises a pay-out means 21 disposed in the upper central area of the panel 11, and a connecting means 22 disposed between the pay-out means 21 and the first and second rolls 12 and 13.

The pay-out means 21 comprises a motor 24 disposed at the rear face side of the panel 11, a drive roller 25 fixed to the output shaft of the motor 24, and a pinch roller 26 disposed at an upper side of the periphery of the drive roller 25 and arranged so that the web material M is paid out in order toward the laminating means 16 owing to the rotation of the motor 24.

Figure 4:
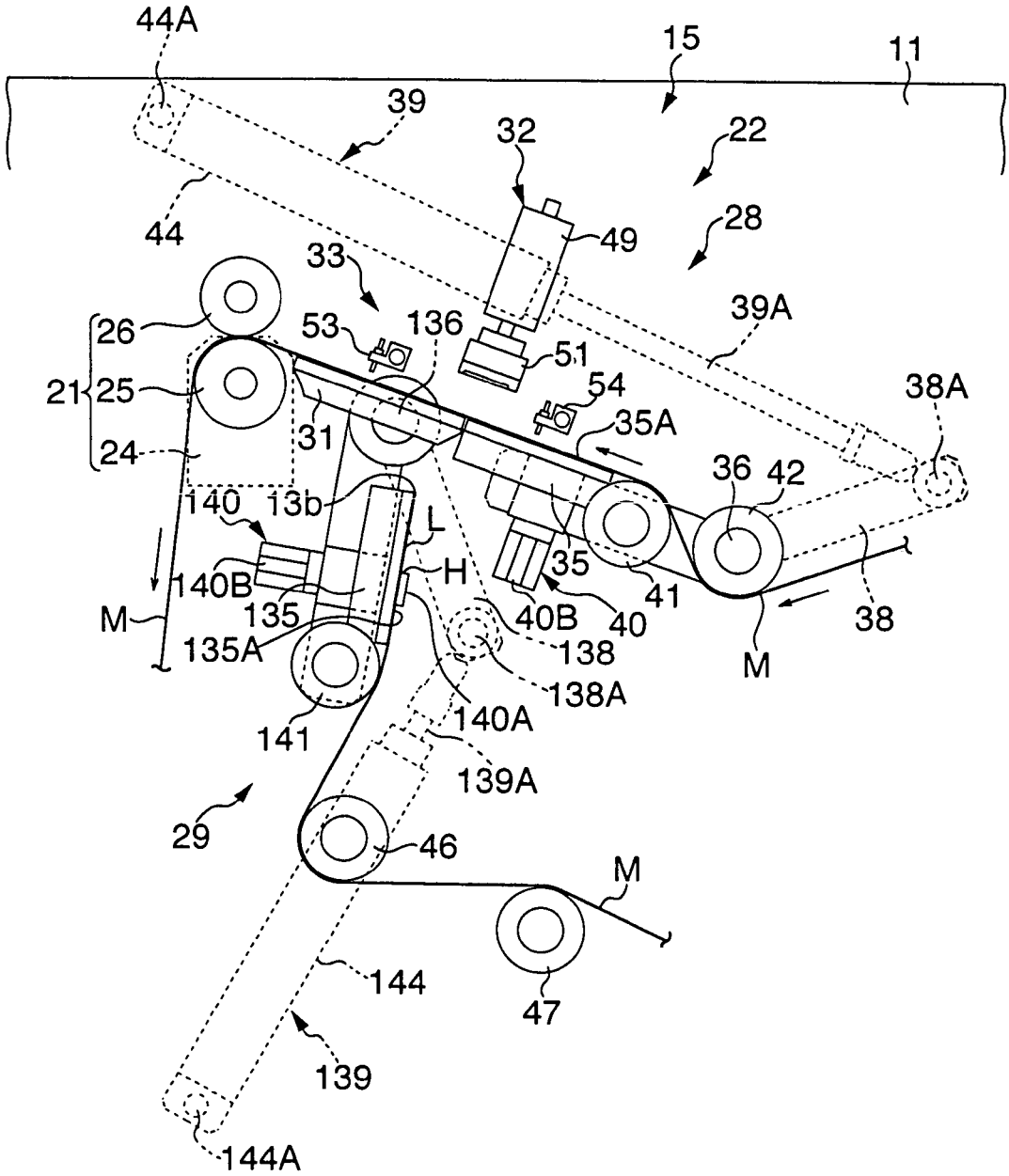
FIG. 4 is an enlarged view showing the connecting apparatus in FIG. 1.
Figure 5:
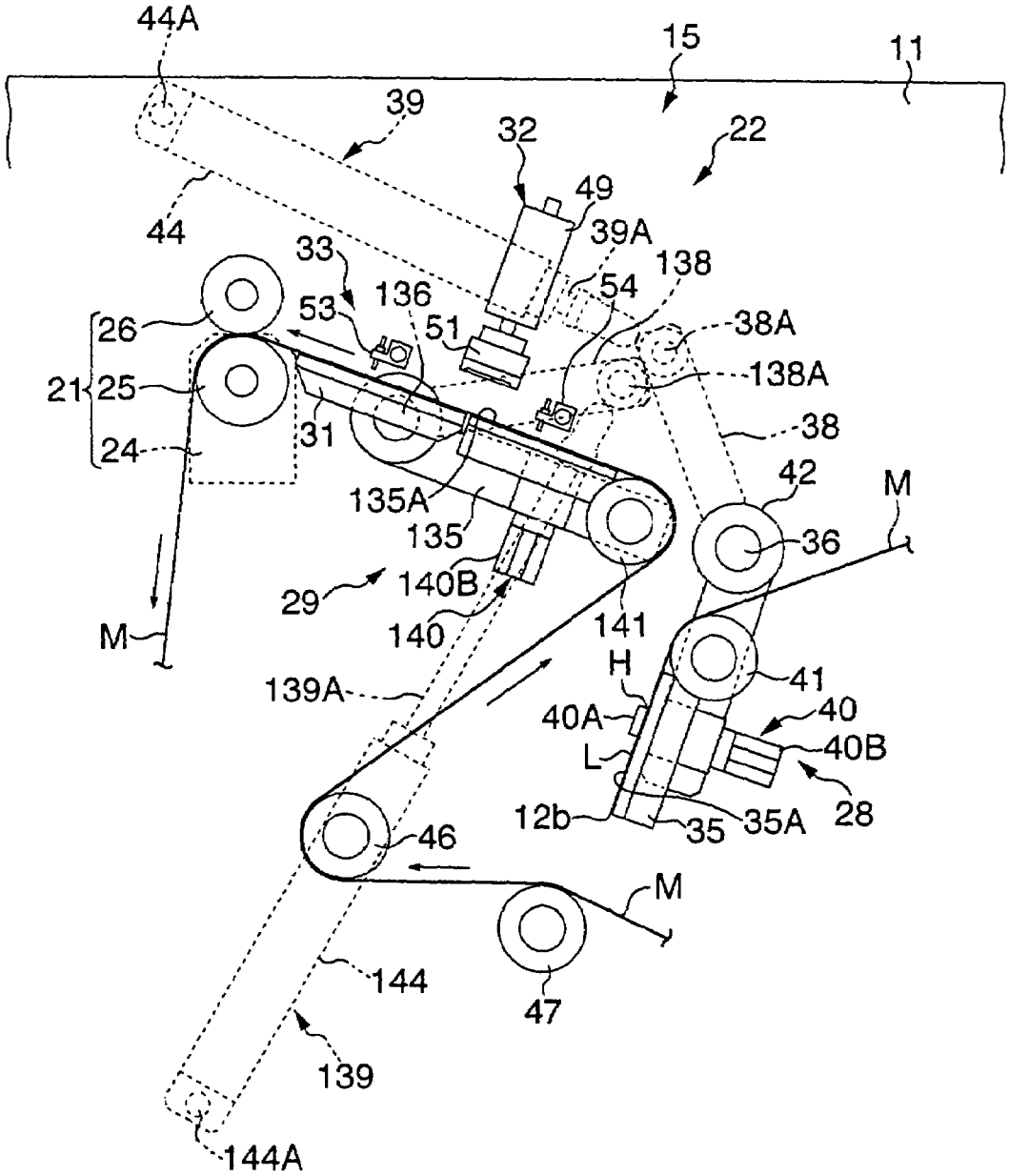
FIG. 5 is an enlarged view of the connecting apparatus in FIG. 2.

As shown in FIG. 4 and FIG. 5, the connecting means 22 comprises a first holding means 28 capable of holding the lead end 12*b* side portion of the web material M from the first roll 12 (refer to FIG. 5), a second holding means 29 capable of holding the lead end 13*b* side portion of the web material M from the second roll 13 (refer to FIG. 4), a receiving table 31 disposed in a right area adjacent to the drive roller 25, capable of holding the web material M from the lower surface side thereof, a pressuring means 32 disposed between the receiving table 31 and the holding sections 35 (135) (which will be described later) of each holding means 28 and 29, and sensors 33 disposed at the right and left sides of the pressuring means 32.

The first holding means 28 comprises the holding section 35, which has a suction surface 35A capable of holding the lead end 12*b* side portion, a rotary shaft 36, which supports the holding section 35 in rotatable condition, and penetrates the panel 11, a cylinder 39 connected to the rotary shaft 36 interposed by an arm 38 positioned at the rear side of the panel 11, and a positioning section 40, which position the web material M on the suction surface 35A. The first holding means 28 is arranged so that, by reciprocating a rod 39A of the cylinder 39, the holding section 35 is rotated to move between the pay-out position shown in FIG. 4 and the waiting position shown in FIG. 5.

The holding section 35 is formed with a plurality of vacuum holes (not shown) at the suction surface 35A side and is connected to a suction mechanism (not shown) of the opposite side of the suction surface 35A via a hose or the like. Disposed between the suction surface 35A and the rotary shaft 36, and at the periphery side of the rotary shaft 36 are guide rollers 41 and 42 which guides the pay-out of the web material M from the first roll 12 to the suction surface 35A. The holding section 35 is arranged so that the suction surface 35A positions substantially even with the upper surface of the receiving table 31 at the pay-out position, and at the waiting position, the holding section 35 does not come into contact with the web material M paid out from the second roll 13.

The cylinder 39 comprises cylinder main body 44 located on the rear face side of the panel 11, supporting the rod 39A. The cylinder main body 44 is supported by the panel 11 via a pivot 44A at the base end side (left side end) thereof, and is arranged to rotate so that the front-end side (right end side) thereof swings up and down. The rod 39A is arranged so that the front-end side thereof is connected to the arm 38 via a hinge 38A so as to rotate with respect to the arm 38.

As shown in FIG. 5, the positioning section 40 comprises a positioning pin 40A, which can be inserted into the round hole H of the first label L at the lead end 12*b* side, and a positioning cylinder 40B, which drives the positioning pin 40A to come out and retreat from the suction surface 35A. In the state that suction surface 35A holds the lead end 12*b* side portion, the positioning pin 40A protrudes from the suction surface 35A to engage with the round hole H, and thus, positions the lead end 12*b*. Owing to this arrangement, the positioned lead end 12*b* is set to a predetermined position in the suction surface 35A, and when the holding section 35 rotates, the lead end 12*b* side portion is prevented from being displaced. Also, the positioning pin 40A is arranged so as to, after completion of the connection between the web material M of the first and second rolls 12 and 13 and just before the pay-out of the web material M is started, at the same time when the suction with the suction surface 35A is released, retreat from the suction surface 35A.

The second holding means 29 has an arrangement similar to the first holding means 28 in such manner that the direction of each of the parts on the first holding means 28 is changed. Accordingly, the parts on the second holding means 29, which are the identical as the parts on the first holding means 28, are indicated using reference numerals of three digits (100), which includes the last two digits reference numerals used for the first holding means 28, and redundant explanations for the structural parts overlapping with each other will be omitted.

In the second holding means 29, as shown in FIG. 4, the holding section 135 has a suction surface 135A capable of holding the lead end 13*b* side portion of the web material M from the second roll 13. The holding section 135 is arranged so as to, by reciprocating the rod 139A of the cylinder 139, rotate between the waiting position shown in FIG. 4 and the pay-out position shown in FIG. 5. Disposed at the opposite side of the rotary shaft 136 of the holding section 135 is a guide roller 141, and it is arranged so that the web material M is guided by two auxiliary rollers 46 and 47, which are located between the guide roller 141 and the second roll 13 to position the web material M on the suction surface 135A. Further, the holding section 135 is arranged so that the suction surface 135A is substantially even with the upper surface of the receiving table 31 at the pay-out position, i.e., the suction surface 135A is positioned at substantially the same pay-out position as that of the suction surface 35A on the first holding means 28, and at the waiting position, the holding section 135 does not come into contact with the web material M, which is paid out from the first roll 12. The cylinder 139 is arranged so as to rotate so that the front-end side (upper end side) thereof swings right and left via the pivot 144A.

The receiving table 31 has a suction surface formed with a plurality of vacuum holes (not shown) at the surface (upper surface) side, which supports the web material M to suck and support the web material M, and it is arranged so that, when the web material M is paid out, the receiving table 31 releases the suction and serves as a pay-out guide of the web material M.

The pressurizing means 32 comprises a pressuring means main body 49 having a cylinder supported by the panel main body 11 and a press plate 51, which is connected to the lower end of the pressuring means main body 49 and has a press face, which is larger than the connecting sheet M1. The pressuring means 32 is arranged so as to give a pressing force to the surface side (upper surface) of the web material M extending between the receiving table 31 and the suction surface 35A (refer to FIG. 4; in FIG. 5, suction surface 135A) via the press plate 51.

The sensor 33 comprises a hole detection sensor 53, which is disposed above the receiving table 31 and detects the round hole H of the web material M, and a tail end detection sensor 54, which is disposed above the suction surface 35A (refer to FIG. 4; in FIG. 5, suction surface 135A) and detects the tail end 12*a* (13*a*) of the web material M. It is arranged so that the detection data from each of the detection sensors 53 and 54 are output to an unshown control unit, and the control unit controls the drive of the motor 24 for the pay-out means 21.

As shown in FIG. 1, the laminating means 16 comprises a peel plate 56 fixed to the panel 11, a suction member 57 disposed above the peel plate 56, a laminating roller 58 disposed at one side (left end side) of the suction member 57, a posture changing means 60, which supports the suction member 57 from the bottom thereof and includes a cylinder member 60A, which changes the position of the suction member 57 between a substantially horizontal position and an inclined position, and a shifting means 61, which shifts the posture changing means 60 in the right and left directions.

The peel plate 56 is disposed so as to peel off the label L from the web material M, which is paid out to the laminating means 16 through a buffer section 62 and plural rollers 63. That is, the web material M is wrapped on the front edge (left edge) of the peel plate 56 so as to turn sharply there; thus, at the front edge of the peel plate 56, the label L can be peeled off toward the left direction in a substantially horizontal plane. The roller 62A constituting the buffer section 62 is provided movably in the up and down direction. The web material M from which the label L has been peeled off, is nipped and transferred by a drive roller 64A and a pinch roller 64B located at the right side of the laminating means 16, paid out through a plurality of rollers 64C, and finally collected into a collection box (not shown) located in a lower portion of the panel 11.

The suction member 57 is disposed so as to suck the label L, which is peeled off by the peel plate 56, working on the upper surface side thereof, and to move above the disk substrate, which is placed on a table (not shown) via the shifting means 61. The laminating roller 58 is arranged so as to give a predetermined press force while rotating on the disk substrate. More specifically, it is arranged so that, in a state that the label L and the disk substrate are aligned with each other, and in an inclined posture such that the laminating roller 58 side of the suction member 57 is lowered via the posture changing means 60, the suction member 57 is shifted; thus, the laminating roller 58 rotates on the disk substrate and the label L is stuck to the disk substrate from the suction member 57.

In FIG. 1 and FIG. 2, reference numerals 65 and 66 denote sensors. These sensors 65 and 66 are disposed at positions respectively sandwiching the first and second rolls 12 and 13 so as to detect tail ends 12*a* (13*a*) of the web material M from the rolls 12 (13). And thus, it is detected whether or not a roll to be paid out next to the roll, of which tail ends 12*a* (13*a*) have been detected, has been set up. It is arranged so that, when the roll to be paid out next is not set up, the operation of the entire equipment is stopped, and an unshown alarm or the like is given to an operator.

Next, the connecting steps of the web material M from the first and second rolls 12 and 13 in the connecting apparatus 15 will be described.

Here, as shown in FIG. 4, the holding section 35 of the first holding means 28 is set to the pay-out position; the holding section 135 of the second holding means 29 is set to the waiting position; and the web material M from the first roll 12 is laid around to pass over the receiving table 31 via the holding section 35 of the first holding means 28, and go through the pay-out means 21. In this state, the sucking operation of the holding section 35 and the receiving table 31 is released, and when the motor 24 of the drive roller 25 is driven, the web material M from the first roll 12 is paid out. When the web material M from the second roll 13 is laid around the auxiliary rollers 46 and 47, and when the round hole H of the first label L at the lead end 13*b* side is engaged with the positioning pin 140A to position the label L, the lead end 13*b* and the upper end of the suction surface 135A in FIG. 4 are substantially aligned with each other, and the lead end 13*b* side portion is sucked and held by the suction surface 135A.

Figure 6:
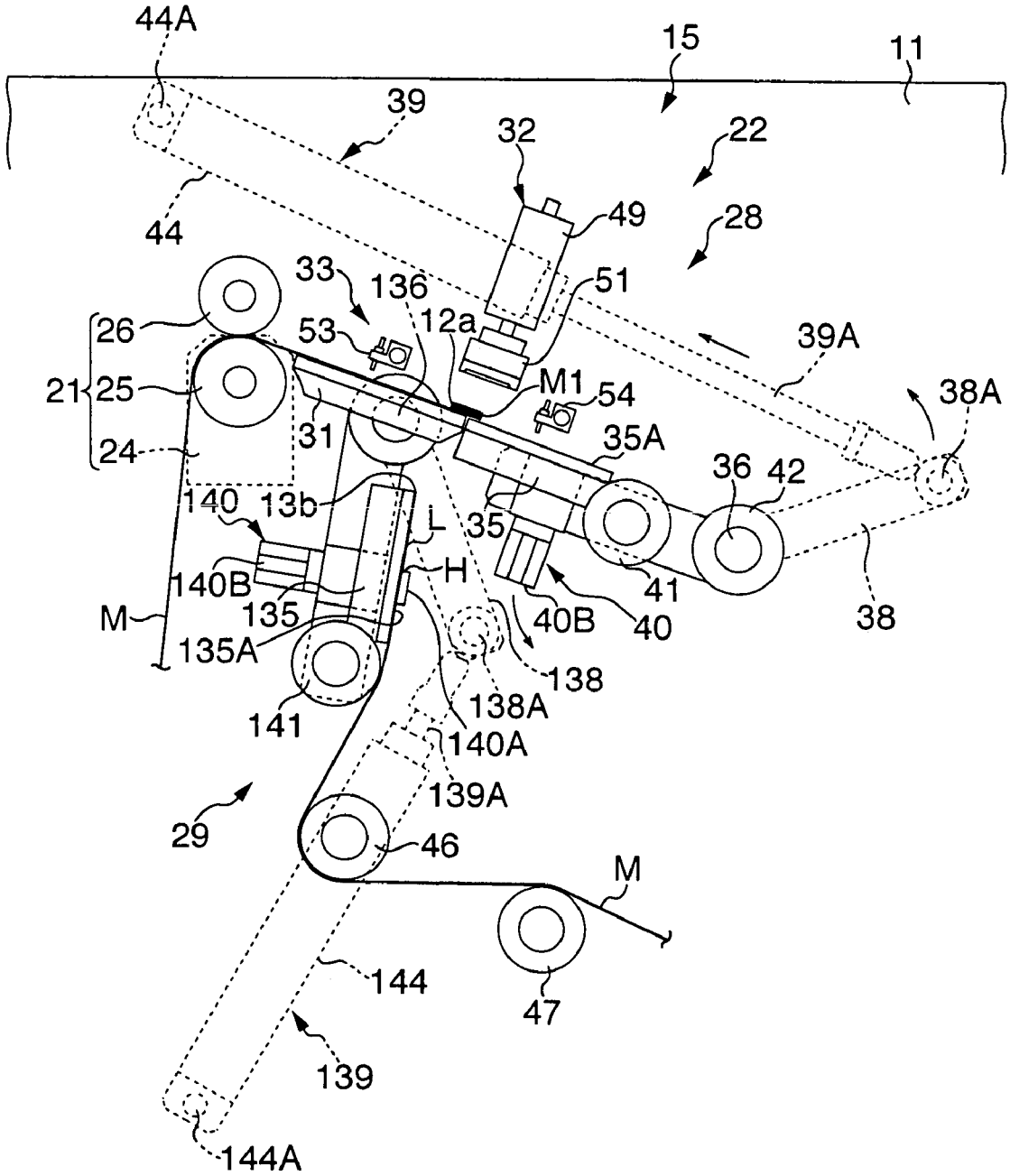
FIG. 6 is the same enlarged view as that in FIG. 4, which illustrates a state that the tail end side portion of the web material in the first roll is positioned in a connecting means.

When the web material M is paid out from the first roll 12 and the remaining wound web material M has run out, the connecting sheet M1 provided to the tail end 12*a* side of the web material M is peeled off from the core 18 of the first roll 12 owing to a drive force of the motor 24. From this state, the pay-out is further carried out, and when the tail end 12*a* of the web material M passes through over the suction surface 35A of the holding section 35, the tail end detection sensor 54 detects the tail end 12*a*. After this detection, when the hole detection sensor 53 detects the round hole H closest to the tail end 12*a*, the drive amount of the motor 24 is adjusted based on the detected data. And as shown in FIG. 6, when the tail end 12*a* of the web material M has reached the end of the holding section 35 side (right end) of the receiving table 31, the pay-out of the web material M is stopped. Owing to this arrangement, the connecting sheet M1 protrudes from the right end of the receiving table 31. In this state, the tail end 12*a* side portion of the web material M is sucked and held by the suction surface of the receiving table 31. Even when the pay-out of the web material M on the receiving table 31 is being stopped, owing to the buffer section 62, the pay-out of the web material M in the downstream from the buffer section 62 is continued.

Figure 7:
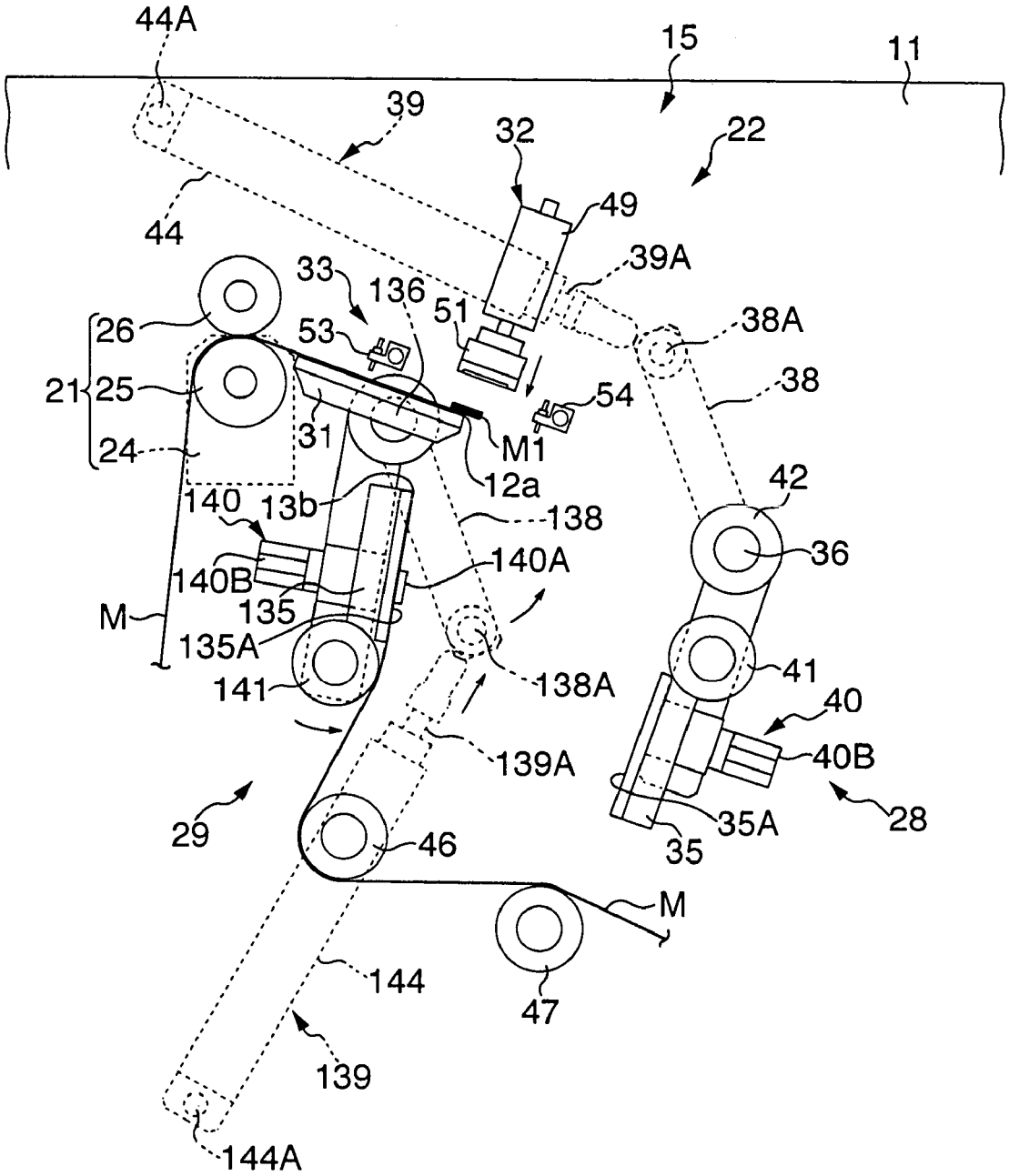
FIG. 7 is the same enlarged view as that in FIG. 4, which illustrates a state that a holding section of a first holding means is shifted from a position shown in FIG. 6 to the waiting position.

After that, when the rod 39A on the cylinder 39 of the first holding means 28 is retreated, the holding section 35 turns counterclockwise via the arm 38, and as shown in FIG. 7, the holding section 35 shifts to the waiting position far away from the receiving table 31.

Figure 8:
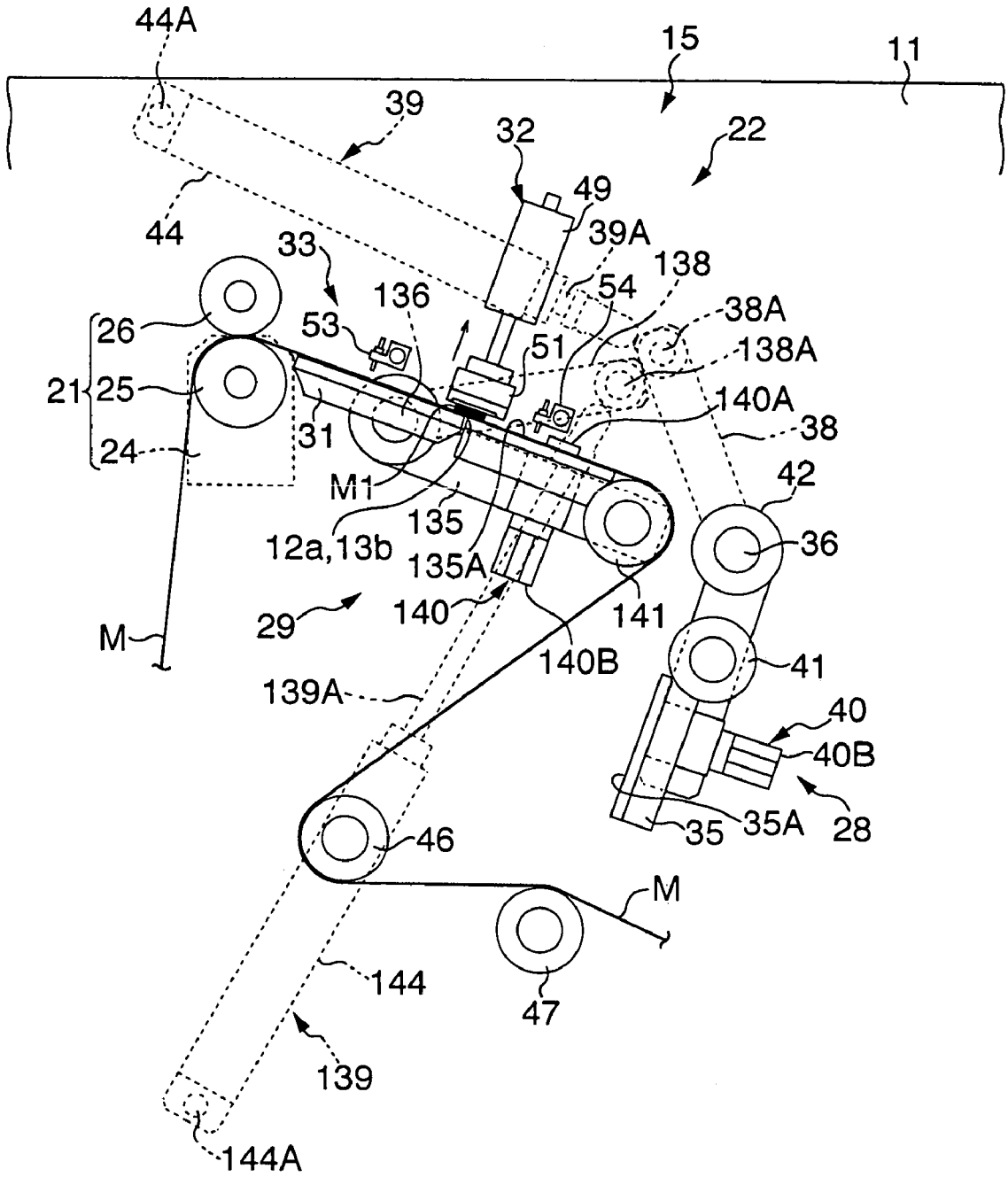
FIG. 8 is the same enlarged view as that in FIG. 4, which illustrates a state that a holding section of a second holding means is shifted from the position shown in FIG. 7 to the pay-out position, and the web material of the first and second rolls are connected with each other.

Then, the rod 139A on the cylinder 139 of the second holding means 29 is made to proceed to turn the holding section 135 counterclockwise via the arm 138. Owing to this arrangement, as shown in FIG. 8, the holding section 135 is set to the pay-out position, and the suction surface 135A of the holding section 135 is positioned substantially even with the suction surface of the receiving table 31. The positioning is made so that the lead end 13*b* of the web material M from the second roll 13 is aligned with the tail end 12*a* of the web material M from the first roll 12 resulting in a state that the lead end 13*b* side portion is overlapped with the connecting sheet M1. And when the press plate 51 of the pressuring means 32 is pressed against the holding section 135 and the receiving table 31, the protruding portion of the connecting sheet M1 is stuck to the lead end 13*b* side portion. Thus, the tail end 12*a* side portion of the web material M from the first web material 12 and the lead end 13*b* side portion of the web material from the second roll 13 are connected to each other.

When the connection has completed, the suction of the web material M by the receiving table 31 and holding section 135 is released, the positioning cylinder 140B is made to retreat to retract the positioning pin 140A from the suction surface 135A, and the motor 24 is driven; thus the web material M from the second roll 13 can be paid out therefrom (refer to FIG. 5). While the pay out is carried out, the first roll 12 is replaced with a new one, and the round hole H of the first label L at the lead end 12*b* side from the first roll 12 is engaged with the positioning pin 40A. Thus, the lead end 12*b* is positioned in a state being aligned with the lower end of the suction surface 35A and the lead end 12*b* side portion from the first roll 12 is held by the holding section 35 of the first holding means 28.

Figure 9:
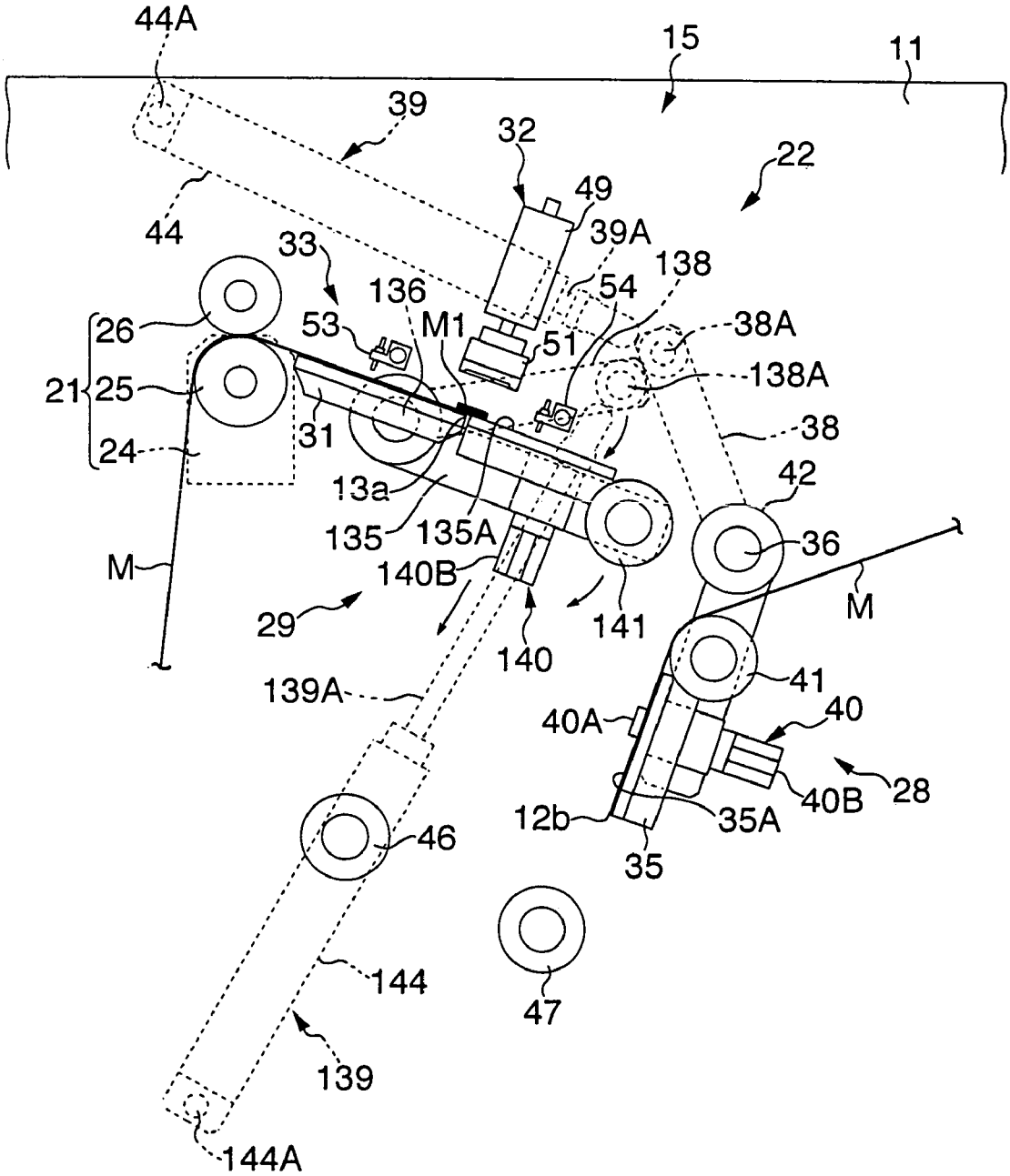
FIG. 9 is the same enlarged view as that in FIG. 4, which illustrates a state that the tail end side portion of the web material in the second roll is positioned in the connecting means.
Figure 10:
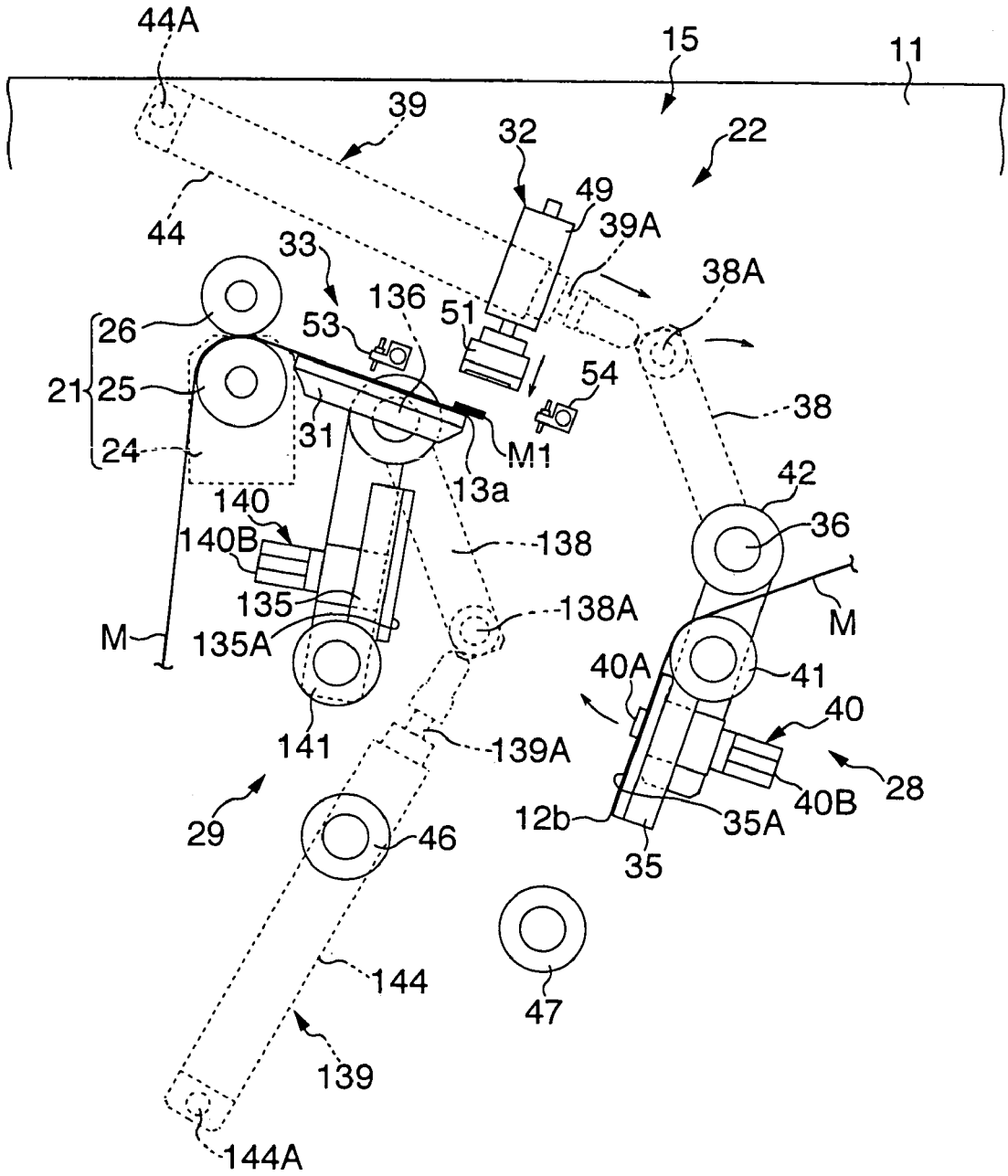
FIG. 10 is the same enlarged view as that in FIG. 4, which illustrates a state that the holding section of the second holding means is shifted from the position shown in FIG. 9 to the waiting position.

As shown in FIG. 9, when the pay-out of the web material M from the second roll 13 is completed, in the same manner as the above-described first roll 12, the tail end 13*a* side portion of the web material M from the second roll 13 is held by the suction surface of the receiving table 31. After that, the rod 139A on the second holding means 29 is made to retreat to turn the holding section 135 clockwise to return the holding section 135 to the waiting position as shown in FIG. 10.

Figure 11:
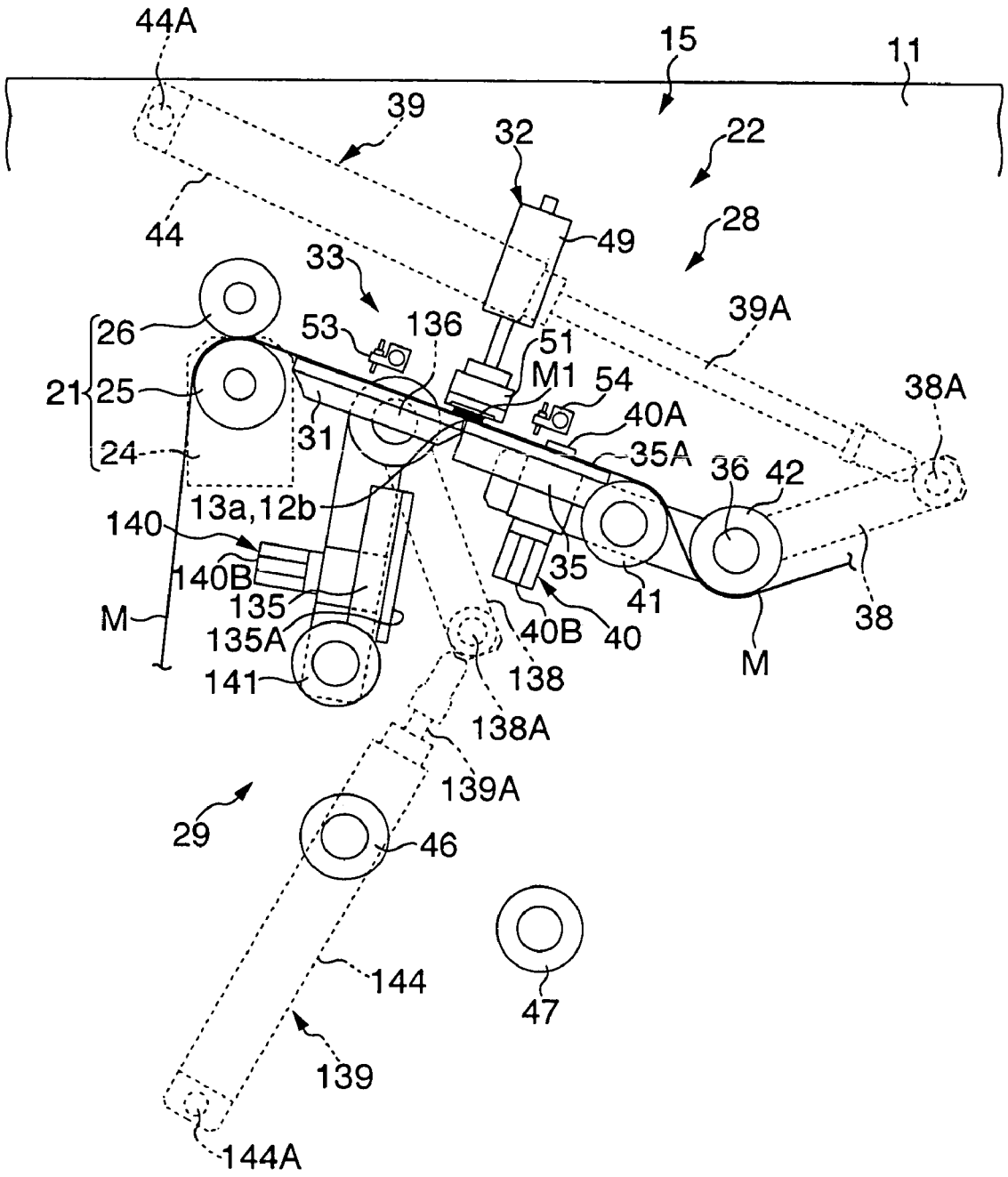
FIG. 11 is the same enlarged view as that in FIG. 4, which illustrates a state that the holding section of the first holding means is shifted from the position shown in FIG. 10 to the pay-out position, and the web material of the first and second rolls are connected with each other.

Then, the rod 39A of the first holding means 28 is made to proceed to turn the holding section 35 clockwise, thereby as shown in FIG. 11, the holding section 35 is returned to the pay-out position. Owing to this arrangement, the lead end 12*b* of the web material M from the first roll 12 and the tail end 13*a* of the web material M from the second roll 13 are aligned with each other resulted in a state that the lead end 12*b* side portion is overlapped with the connecting sheet M1. In this state, in the same manner as the above, via the pressuring means 32, the lead end 12*b* side portion of the web material M from the first roll 12 and the tail end 13*a* side portion of the web material M from the second roll 13 are connected with each other.

The above steps are repeated, and thereby the web material M can be sequentially paid out from the first and second rolls 12 and 13.

Thus, according to the above-described embodiment, at the tail end 12*a* (13*a*) side of the web material M, a connecting sheet M1, which has a reusable adhesive layer, is provided. Accordingly, using the connecting sheet M1, each of the web material M from the first and second rolls 12 and 13 can be connected swiftly. Further, by means of the first and second holding means 28 and 29 and the receiving table 31, the positioning to align the tail end 12*a* (13*a*) from one roll 12 (13) and the lead end 13*b* (12*b*) from the other roll 13 (12) with each other is carried out. Accordingly, the step to cut off the tail ends 12*a* (13*a*) and the lead end 13*b* (12*b*) from each of the rolls 12 and 13 is not required. Therefore, a unit for cutting the material, a waste collecting mechanism and the like can be eliminated resulting in miniaturization and simplification of the entire apparatus. And further, the labels L can be used to the end thereof eliminating the waste of the labels L.

The best mode of the configuration and the method for carrying out the present invention has been disclosed in the above description. However, the present invention is not limited to the above.

That is, the present invention has been illustrated and described particularly with respect to a specific mode of the embodiment. However, it is possible for one skilled in the art to give a variety of modifications to the shape, material, quantity, and other detailed configuration with respect to the above-described mode of embodiment without departing from the technical spirit and the range of the object of the present invention.

For example, in addition to the configuration of the above-described embodiment, such arm or robot that, when replacing each of the rolls 12 and 13, holds the lead end 12*b* (13*b*) side of these web material M, and holds the lead end 12*b* (13*b*) side portion to the suction surface 35A (135A) may be provided.

Further, as for the above described web material M, in addition to the configuration in which the labels L are laminated over the base sheet B, another web material such as web material without the label L or web-like sheet may be employed.

The present invention is employed in a laminating apparatus using web material, which is sequentially paid out from a plurality of rolls, and the like.

What is claimed is:

1. A connecting apparatus for web material, comprising:

a pay-out means arranged so as to sequentially pay out first and second rolls of web material to which substantially a half area of a piece of connecting sheet is stuck at the tail end side thereof, and a connecting means, which connects the tail end side portion of the web material from one roll and the lead end side portion of the web material from another roll to each other, wherein said connecting means comprises a first holding means for holding the lead end side portion of the web material from a first roll, a second holding means for holding the lead end side portion of the web material from a second roll, a receiving table for holding the web material from the first and second rolls from a lower surface side thereof, and a pressuring means, wherein said pressuring means is disposed between the receiving table and said first holding means when the web material is paid out from said first roll of web material, and wherein said pressuring means is disposed between said receiving table and said second holding means when the web material is paid out from said second roll of web material, and said connecting means, when the tail end of the web material from said one roll reaches a predetermined position, in a state that the tail end and said lead end are aligned with each other, gives a pressing force via said pressurizing means to an upper surface side of the web material extending between the receiving table and either said first holding means or said second holding means, thereby connecting each of the web material from the first and second rolls via said connecting sheet.

2. A connecting apparatus for web material according to claim 1, each of said first and second holding means comprises the holding section which has a suction surface capable of holding the lead end side portion, and is arranged so that the holding section is rotated to move between a pay-out position and an waiting position.

3. A connecting method of web material using a pay-out means, which sequentially pays out first and second rolls of web material to which substantially a half area of a piece of a connecting sheet is stuck at the tail end side thereof, and a connecting means, which connects the tail end side portion of the web material from one roll and the lead end side portion of the web material from another roll to each other, comprising the steps of:

after said tail end has reached a predetermined position by said pay-out means, positioning said tail end and said lead end to align with each other with the connecting means, and then applying the remaining half portion of said connecting sheet to the lead end portion from a roll to be connected with said connecting means; wherein said connecting means comprises a first holding means for holding the lead end side portion of the web material from a first roll, a second holding means for holding the lead end side portion of the web material from a second roll, a receiving table for holding the web material from the first and second rolls from a lower surface side thereof, and a pressuring means, wherein said pressuring means is disposed between the receiving table and said first holding means when the web material is paid out from said first roll of web material, and wherein said pressuring means is disposed between said receiving table and said second holding means when the web material is paid out from said second roll of web material, and wherein said pressurizing means gives a pressing force to an upper surface side of the web material extending between the receiving table and either said first holding means or said second holding means, thereby connecting each of the web material from the first and second rolls via said connecting sheet.

* * * * *